US012752210B2

(12) United States Patent
Chen

(10) Patent No.: US 12,752,210 B2
(45) Date of Patent: Oct. 6, 2026

(54) TOY WATER BALL

(71) Applicant: Dongguan Saienchuangke Technology Co., Ltd, Dongguan (CN)

(72) Inventor: Yunfeng Chen, Dongguan (CN)

(73) Assignee: Dongguan Saienchuangke Technology Co., Ltd., Dongguan (CN)

( * ) Notice: Subject to any disclaimer, the term of this patent is extended or adjusted under 35 U.S.C. 154(b) by 0 days.

(21) Appl. No.: 17/549,920

(22) Filed: Dec. 14, 2021

(65) Prior Publication Data

US 2022/0203256 A1 Jun. 30, 2022
US 2026/0027487 A2 Jan. 29, 2026

(30) Foreign Application Priority Data

Dec. 25, 2020 (CN) ..... 202011567478.4

(51) Int. Cl.
*A63H 33/18* (2006.01)
*A63H 33/04* (2006.01)
*A63B 39/06* (2006.01)

(52) U.S. Cl.
CPC ..... *A63H 33/18* (2013.01); *A63H 33/046* (2013.01); *A63B 39/06* (2013.01)

(58) Field of Classification Search
CPC ..... A63H 33/046; A63H 33/18
See application file for complete search history.

(56) References Cited

U.S. PATENT DOCUMENTS 1,229,794 A * 6/1917 Salzer ..... F21V 33/00 362/253
1,409,082 A * 3/1922 Corbett ..... A63F 9/12 273/157 R (Continued)

FOREIGN PATENT DOCUMENTS

CN 201503247 U 6/2010
CN 201543247 U † 8/2010

(Continued)

OTHER PUBLICATIONS

Prime Time Toys Hurricane Reuseable Water Balls—12-Pack Reusable Silicone Water Balloons with Self Sealing Quick Fill for Age 5+, Safe No Magnets, (Release Date: Nov. 25, 2019). Amazon.com, www.amazon.com/Prime-Time-Toys Hurricane-Resuable/dp/B082DZ7FV8 (8 pages).

(Continued)

*Primary Examiner* — Michael D Dennis
*Assistant Examiner* — Matthew B Stanczak
(74) *Attorney, Agent, or Firm* — Finnegan, Henderson, Farabow, Garrett & Dunner LLP

(57) ABSTRACT

A toy water ball includes a plurality of petals each having a first edge portion and a second edge portion. Each first edge portion is provided with first magnetic members, and each second edge portion is provided with second magnetic members. When all petals are closed to form a spherical shape, an attraction force is generated between the first magnetic members of each petal and the second magnetic members of the adjacent petal so that the first edge portion of the petal tightly fit the second edge portion of the adjacent petal and a water-carrying cavity is formed. The toy water ball can be closed or opened repeatedly and can be reused. Thus, it is environmentally friendly and clean. Furthermore, the toy water ball can be filled with water in a common water source without a specific pressure, so it can be used in many occasions, and has strong applicability.

17 Claims, 13 Drawing Sheets

(56) References Cited

U.S. PATENT DOCUMENTS 1,524,367 A * 1/1925 Papageorge ..... A23G 9/506 426/138
3,029,077 A * 4/1962 Benkoe ..... A63H 33/18 446/85
3,618,955 A 11/1971 Barnes
3,646,676 A * 3/1972 Mitchell ..... A61C 13/235 433/189
3,672,083 A * 6/1972 Moran ..... A63H 3/06 40/540
3,691,704 A * 9/1972 Novak ..... E04B 1/3211 220/4.12
3,726,026 A * 4/1973 Borcherding ..... G09B 1/08 434/430
3,763,908 A * 10/1973 Norman ..... B60J 11/00 150/166
D255,988 S * 7/1980 Mascia ..... D9/518
4,212,460 A * 7/1980 Kraft ..... A63B 65/00 473/577
4,292,999 A * 10/1981 Szollmann ..... F16K 15/20 137/232
4,542,445 A * 9/1985 Marletta ..... F21V 3/023 446/224
4,625,967 A 12/1986 Yu
4,736,281 A * 4/1988 Neumeier ..... F21V 3/023 362/186
4,737,133 A * 4/1988 Neumeier ..... G08B 5/00 446/222
4,794,498 A * 12/1988 Neumeier ..... A63H 27/10 362/186
4,823,943 A * 4/1989 Chang ..... A45C 11/005 D3/264
4,886,273 A * 12/1989 Unger ..... A63H 33/046 273/455
4,991,847 A * 2/1991 Rudell ..... A63F 9/0278 473/594
4,997,403 A * 3/1991 Akman ..... F21V 3/023 446/485
5,016,154 A * 5/1991 Leeyeh ..... F21V 21/10 362/431
5,018,450 A * 5/1991 Smith ..... F42B 12/40 102/513
5,075,830 A * 12/1991 Perez ..... A63H 27/10 362/253
5,083,250 A * 1/1992 Malcolm ..... G09F 21/06 362/202
5,119,281 A * 6/1992 Akman ..... F21V 3/023 446/485
5,127,652 A * 7/1992 Unger ..... A63F 9/0278 446/419
5,138,535 A * 8/1992 Aragon, Jr. ..... A63H 33/30 446/175
5,240,450 A * 8/1993 Graham ..... F42B 12/50 473/577
5,254,379 A * 10/1993 Kotsiopoulos ..... B29C 66/71 428/34.1
5,499,941 A * 3/1996 Penjuke, Sr. ..... F21V 3/023 137/853
5,538,456 A * 7/1996 Liu ..... A63H 33/30 473/577
5,688,567 A * 11/1997 Daulton ..... G09F 19/125 428/11
5,848,946 A * 12/1998 Stillinger ..... A63B 21/00069 473/594
5,879,219 A * 3/1999 Penjuke ..... F21V 3/023 137/853
5,951,140 A * 9/1999 Feldman ..... H05B 33/02 362/253
5,975,983 A * 11/1999 Panec ..... A63H 33/30 141/114
6,050,438 A * 4/2000 Kovens ..... B65D 11/02 220/4.24
6,163,889 A * 12/2000 Tate ..... A63B 57/353 2/209.13
6,250,005 B1 * 6/2001 Richards ..... B65D 25/36 150/901
6,250,985 B1 * 6/2001 Nicholson ..... A63H 37/00 446/368
6,422,559 B1 * 7/2002 Utkin ..... A63F 9/0834 74/29
6,527,616 B1 * 3/2003 Li ..... A63B 43/005 473/574
6,533,637 B1 * 3/2003 Liao ..... A63H 33/00 446/486
D473,160 S 4/2003 Weissman
6,840,836 B1 * 1/2005 Siverson ..... A63H 33/18 264/328.17
7,204,740 B2 * 4/2007 Petell ..... G09F 21/06 362/362
7,481,727 B2 * 1/2009 Chia ..... A63B 43/00 473/577
7,547,019 B2 * 6/2009 Chen ..... A63F 9/0865 273/156
7,825,944 B2 * 11/2010 Kaiya ..... B41J 29/13 347/108
7,854,642 B2 * 12/2010 Nelson ..... A63H 27/10 446/224
9,957,707 B1 * 5/2018 Cooper, Jr. ..... F21S 4/20
10,197,210 B2 * 2/2019 Hoffman ..... F16L 59/14
D858,985 S 9/2019 Lynch
10,449,467 B1 * 10/2019 Vaca ..... A63H 37/00
10,562,663 B2 * 2/2020 Mowbray ..... B65D 11/02
10,704,761 B1 * 7/2020 Zhu ..... F21V 19/00
D903,838 S 12/2020 Harrison et al.
D905,500 S 12/2020 Zhu
10,888,798 B1 * 1/2021 Vaca ..... A63H 33/00
11,198,041 B2 * 12/2021 Oh ..... A63B 43/004
11,358,072 B2 * 6/2022 Greenwood ..... A63H 23/12
11,426,674 B2 * 8/2022 Mowbray ..... A63H 33/003
11,786,835 B1 * 10/2023 Xiong ..... A63B 39/08 446/267
D1,030,929 S * 6/2024 Chen ..... A63H 33/046 D21/713
2002/0089843 A1 * 7/2002 Lou ..... F21V 3/023 362/186
2004/0174718 A1 * 9/2004 Ohlund ..... B64B 1/50 362/565
2004/0233674 A1 * 11/2004 Vanderschuit ..... G09F 21/10 362/352
2005/0170739 A1 * 8/2005 Zoellner ..... A63H 33/046 446/92
2005/0248090 A1 * 11/2005 Anders ..... A63F 9/0865 273/156
2005/0269442 A1 * 12/2005 Nguyen ..... A63H 27/10 244/31
2006/0037682 A1 * 2/2006 Reiter ..... A45C 13/26 150/107
2006/0104070 A1 * 5/2006 Carito ..... A63H 27/10 362/800
2006/0141898 A1 * 6/2006 Petell ..... A63H 27/10 446/220
2006/0234600 A1 * 10/2006 Pacheco ..... A63H 33/046 446/124
2006/0291217 A1 * 12/2006 Vanderschuit ..... A63H 33/22 362/363
2007/0167107 A1 * 7/2007 Petell ..... A63H 27/10 446/220
2008/0032588 A1 * 2/2008 Sun ..... G09F 21/10 362/565
2008/0090487 A1 * 4/2008 Randall ..... A63H 33/22 446/225
2010/0048097 A1 * 2/2010 Ma ..... F21S 4/22 446/485
2010/0194043 A1 * 8/2010 Pavlovic ..... A63F 9/0873 273/157 R
2010/0246165 A1 * 9/2010 Diaz ..... A63H 33/22 362/183

(56) References Cited

U.S. PATENT DOCUMENTS

2010/0301558 A1* 12/2010 Speegle ..... A63F 9/12 273/153 S
2011/0003655 A1* 1/2011 Chernick ..... A63B 39/00 446/491
2012/0100775 A1* 4/2012 Marciano ..... A63H 23/00 446/153
2012/0148765 A1* 6/2012 Halliburton ..... A63H 27/10 156/292
2013/0061431 A1* 3/2013 Naftali ..... A45C 13/1069 24/303
2014/0096867 A1* 4/2014 Cayton ..... F21S 10/02 141/98
2014/0137450 A1* 5/2014 Knez ..... G09F 7/18 40/600
2014/0221136 A1* 8/2014 Forutanpour ..... A63B 59/00 473/569
2014/0295728 A1* 10/2014 Cayton ..... F21V 3/026 446/220
2014/0295732 A1* 10/2014 Henrik ..... A63H 27/10 446/485
2014/0342859 A1* 11/2014 Newman ..... A63B 45/00 473/607
2015/0224863 A1* 8/2015 Yang ..... B60J 11/08 150/168
2015/0314213 A1* 11/2015 Zhou ..... A63H 33/22 446/485
2016/0001918 A1* 1/2016 Orion ..... B65D 11/02 220/4.24
2016/0018083 A1* 1/2016 Kelly ..... A63H 33/22 362/372
2016/0021915 A1* 1/2016 Baxter ..... B65D 85/60 426/295
2016/0074759 A1* 3/2016 Kelly ..... A63H 1/24 446/242
2016/0120337 A1 5/2016 Cruz
2017/0021232 A1* 1/2017 Sullivan ..... A63B 37/0044
2017/0266578 A1* 9/2017 Apyshkov ..... A63H 33/046
2017/0293060 A1* 10/2017 Hayashi ..... A63H 27/10
2018/0059319 A1* 3/2018 Carlyle ..... A63H 27/10
2018/0229885 A1* 8/2018 Mowbray ..... B65D 5/009
2019/0201749 A1* 7/2019 Burke ..... A63B 37/004
2019/0374788 A1* 12/2019 Ko ..... A61F 13/0206
2020/0184852 A1* 6/2020 Hartloff ..... G09B 27/08
2021/0379503 A1* 12/2021 Kelly ..... A63H 33/22
2021/0387105 A1* 12/2021 Greenwood ..... A63H 33/18
2022/0203256 A1* 6/2022 Chen ..... A63B 67/002
2022/0379232 A1* 12/2022 Kelly ..... A63H 33/28
2023/0111031 A1* 4/2023 Kelly ..... A63H 33/22 446/219
2023/0277953 A1* 9/2023 Kelly ..... A63H 33/22 446/15
2023/0277954 A1* 9/2023 Kelly ..... A63H 30/04 446/15
2024/0058715 A1* 2/2024 Kelly ..... A63H 27/10
2024/0066424 A1* 2/2024 Kelly ..... A63H 33/28
2024/0325829 A1* 10/2024 Du ..... A63B 43/04
2025/0303317 A1* 10/2025 Chen ..... A63B 67/002
2025/0303318 A1* 10/2025 Chen ..... A63B 67/002
2025/0303319 A1* 10/2025 Chen ..... A63B 67/002
2025/0303320 A1* 10/2025 Chen ..... A63B 67/002
2026/0054190 A1* 2/2026 Bai ..... A63H 23/12

FOREIGN PATENT DOCUMENTS

CN 201969287 U † 9/2011
CN 203013049 U 6/2013
CN 103237473 B 12/2015
CN 108325218 A 7/2018
CN 210259235 U 4/2020
CN 211445401 U 9/2020
CN 212112652 U † 12/2020
DE 20203193 U1 8/2002
ES 1093855 U 2/2014
JP 3019826 U 1/1996
JP H09203464 A 8/1997
JP 2002128059 A 5/2002
JP 2006137461 A 6/2006
JP 2008099907 A 5/2008
JP 2012239938 A 12/2012
WO 2018150328 A1 8/2018
WO 2021257572 A1 12/2021

OTHER PUBLICATIONS

Sphere Shaped Ice Filled With Fruit. (Published Aug. 24, 2016). Youtube.com. www.youtube.com/watch?v=ExT6pF6pUQM (4 pages).
Creality Modelling campaign: Pokeball with hinge. (Published Sep. 25, 2020). Crealitycloud.com. www.crealitycloud.com/model-detail/616ff06df6bf107ce0c47769 (1 page).
Hao, Xu., "Seal", Beijing: Metallurgical Industry Press Mar. 1999 ISBN 7-5024-296-X China National Library of Publications CIP Data Verification No. 98 38294 (Published: Mar. 1999).

* cited by examiner
† cited by third party

TOY WATER BALL

CROSS-REFERENCE TO RELATED APPLICATION

The present application claims priority to Chinese Patent Application No. 202011567478.4, titled "Toy Water Ball" filed on Dec. 25, 2020, the entire contents of which are incorporated herein by reference.

FIELD

The invention relates to the field of entertainment toys, in particular to a toy water ball.

BACKGROUND

As the weather gets hotter, toys that use water as the medium are more popular and people can play with them, for example, water guns, and feel cooling. However, water guns have high risk of hurting people, especially in the eyes, due to the high pressure of water jetted. At present, there is a game of throwing a water ball, in which a balloon filled with water is thrown at a player. The player who is hit will get wet by the water due to the balloon burst. The player will try to avoid the flying water ball as much as possible. This game is safe and can bring great fun and coolness for people, so it is really a good activity for people to play in summer.

However, the balloons used in the current water ball activities can only be used once and can't be reused after bursting. The large number of used balloons is likely to cause environmental pollution. In addition, to play with this water ball, water needs to be injected into the balloons under pressure, so this game often requires an environment with a water tap. Many people like to play it in places with water such as grassland, seaside or riverside in the suburbs. However, under normal atmospheric pressure, it is difficult to directly inject water into balloons to expand them. Therefore, it is difficult to inject water to sufficiently expand the water ball on the spot due to the lack of water pressure in the natural environment. As a result, this game is limited by an environment.

SUMMARY

Based on various embodiments of the present application, a toy water ball that can be reused and can be used in many occasions is provided.

A toy water ball, comprising a plurality of petals, wherein each of the petals comprises a first edge portion and a second edge portion, each of the first edge portions is provided with at least one first magnetic member, and each of the second edge portions is provided with at least one second magnetic member; when the petals are closed to form a spherical shape, an attraction force is generated between the first magnetic members on the first edge portion of each of the petals and the second magnetic members on the second edge portion of an adjacent petal so that the first edge portion of the petal tightly fits with the second edge portion of the adjacent petal and the petals cooperatively form a water-carrying cavity therebetween.

The beneficial effects of the invention are as follows.

The toy water ball of the invention is provided with the first magnetic members and the second magnetic members, so that the toy water ball can be folded or opened repeatedly and thus can be reused; therefore, the water ball is environmentally friendly and clean. In addition, the toy water ball can be filled with water in a common water source without a specific pressure, so it can be used in many occasions, and has strong applicability.

DETAILED DESCRIPTION

Figure 1:
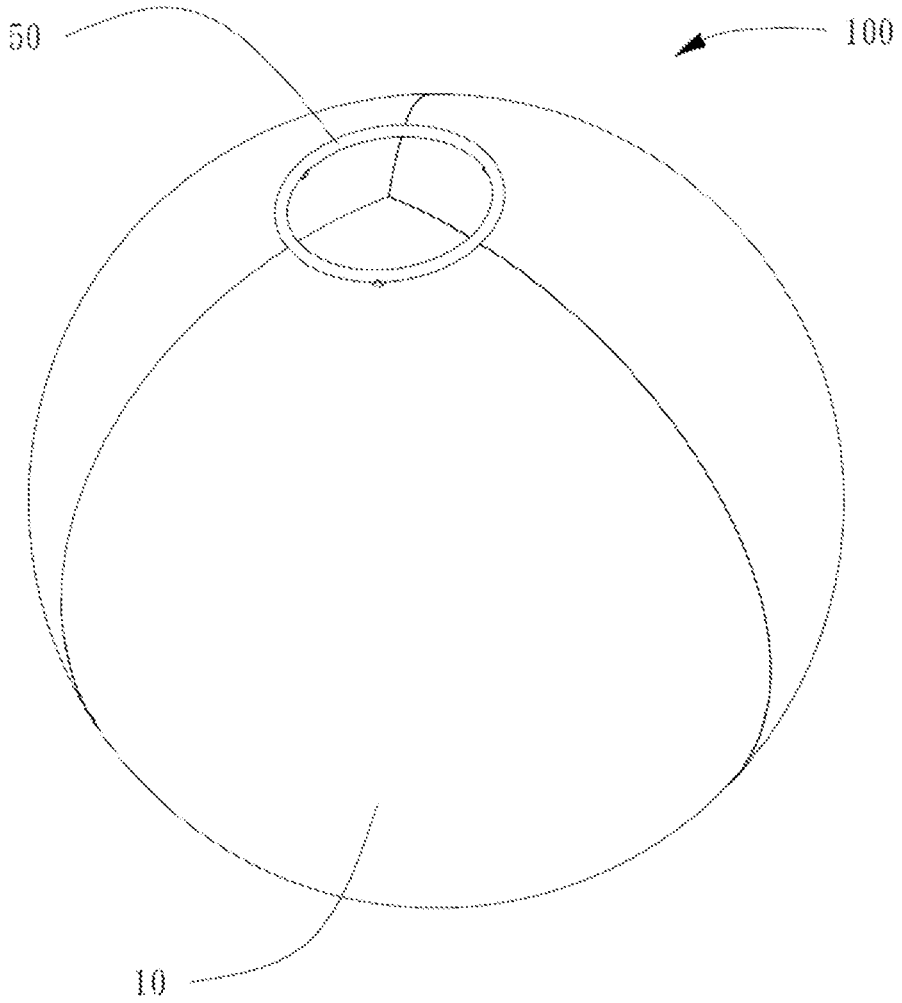
FIG. 1 is a perspective schematic view of a toy water ball according to a first embodiment of the invention.
Figure 2:
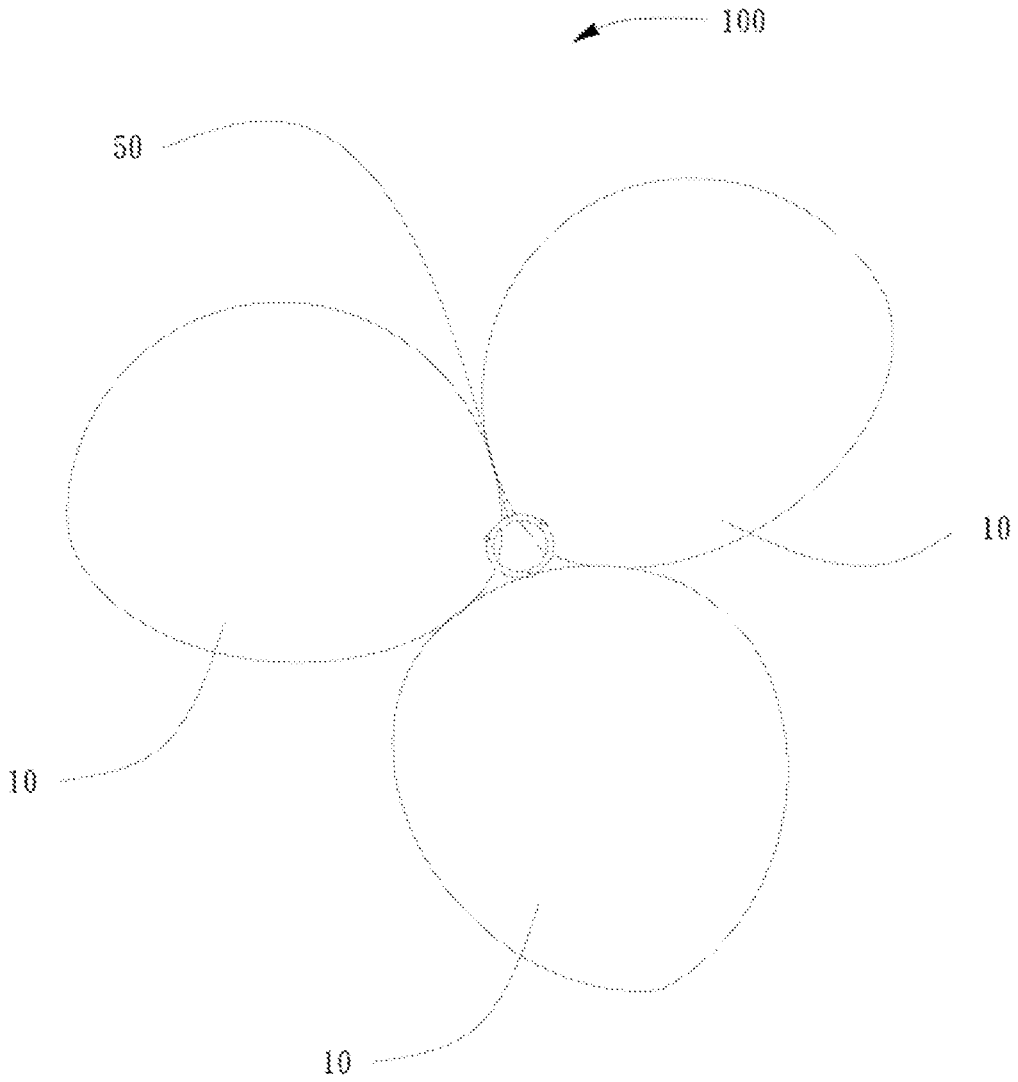
FIG. 2 is a perspective schematic view of the toy water ball of FIG. 1 in an unfolded state.
Figure 3:
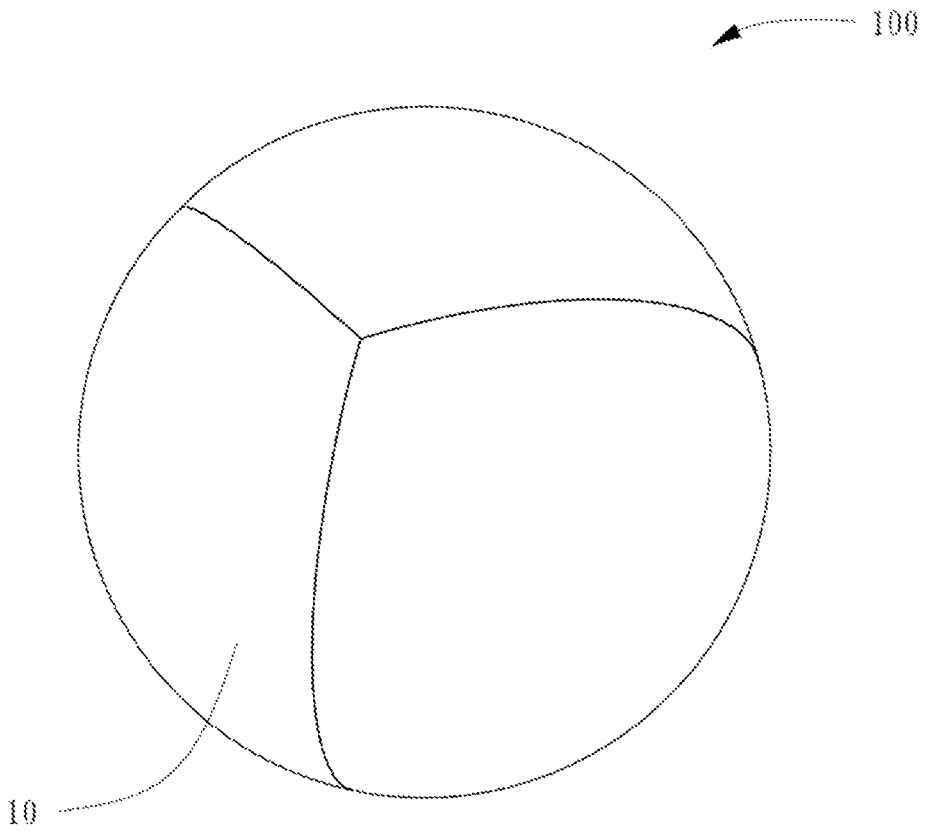
FIG. 3 is a perspective schematic view of the toy water ball of FIG. 1, viewed from another aspect.
Figure 4:
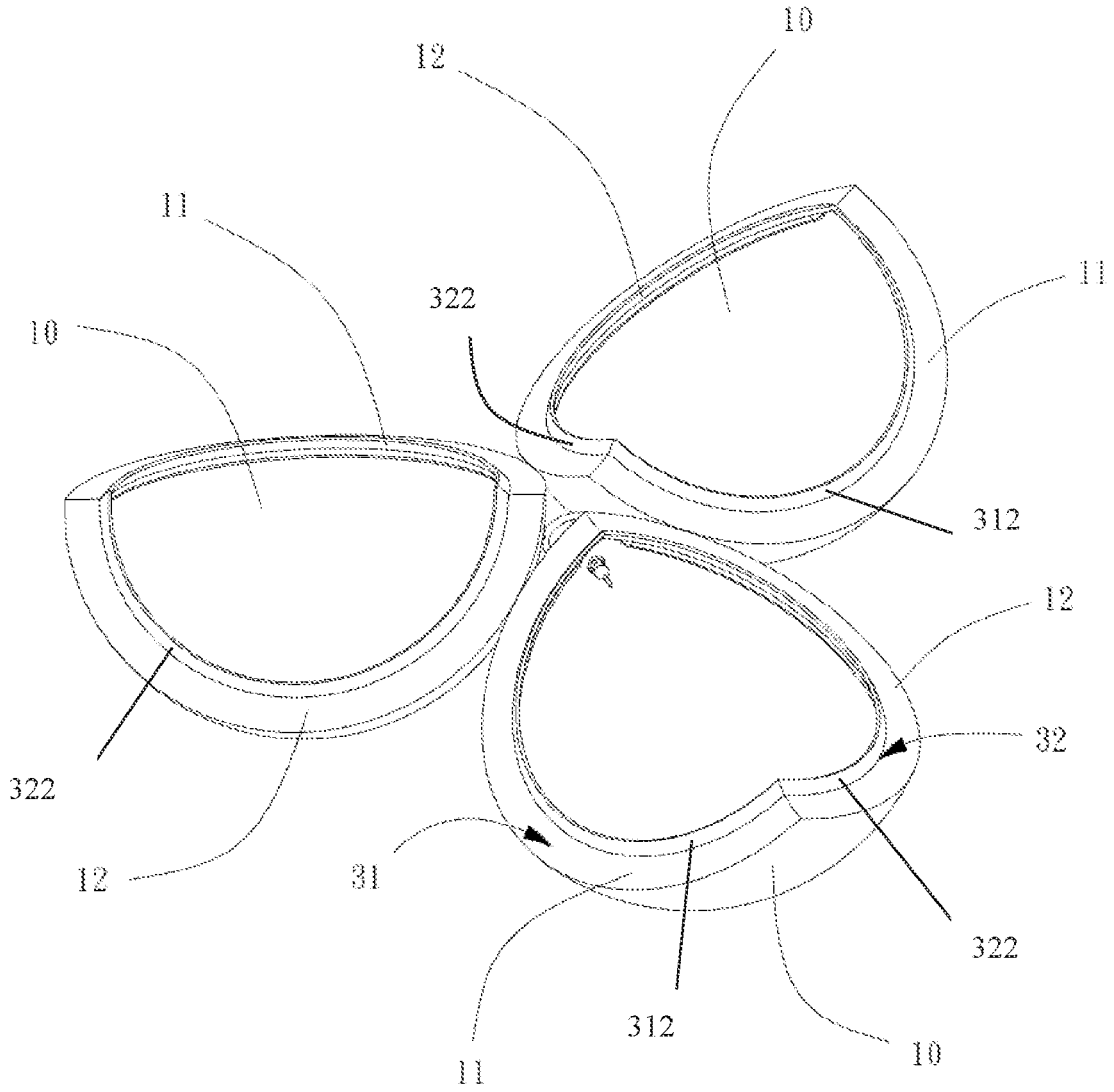
FIG. 4 is a perspective schematic view of the toy water ball of FIG. 3 in an unfolded state.

For easy understanding of the invention, a more comprehensive description of the invention will be given below. However, the invention may be implemented in many different forms and is not limited to the embodiments described herein. On the contrary, these embodiments are provided to make the contents disclosed by the invention understood more thoroughly and comprehensively.

Unless otherwise defined, all technical and scientific terms used herein have the same meaning as commonly understood by those skilled in the technical field to which the invention belongs. The terms used herein in the specification of the invention are for the purpose of describing specific embodiments only but not intended to limit the invention.

Referring to FIGS. 1 to 7, a toy water ball of a first embodiment of the invention can be thrown as a prop in games and entertainment. The toy water ball has a folded state and an unfolded state. When the toy water ball is placed into water and filled with water, and after the water ball returns to a combined state, the toy water ball forms a closed water-carrying cavity. When the toy water ball hits a person or hits the ground or a hard object during the game, the toy water ball is squeezed or compressed to split and turns to the unfolded state, and the loaded or carried water splashes to achieve the purpose of the game and entertainment.

Specifically, as shown in FIGS. 1 to 4, the toy water ball 100 according to the first embodiment of the invention includes a plurality of petals 10, and each of the petals 10 has a first edge portion 11 and a second edge portion 12; each of the first edge portions 11 is provided with a first magnetic member 21, and each of the second edge portions 12 is provided with a second magnetic member 22. When all the petals 10 are folded and closed to form a spherical shape, the first magnetic member 21 on the first edge portion 11 of each of the petals 10 and the second magnetic member 22 on the second edge portion 12 of the adjacent petal 10 attract each other so that the first edge portion 11 of the petal 10 tightly fits with the second edge portion 12 of the adjacent petal 10, and in this way, every two adjacent petals 10 are connected and fit together in sequence, and all the petals 10 together form a water-carrying cavity.

In this embodiment, the toy water ball 100 has three petals 10, and each of the petals 10 is configured as a one-third-sphere shell. When in the combined state, the three petals 10 are close to each other in pairs and fit together to cooperatively form the water-carrying cavity enclosed by the three petals 10. In this embodiment, the toy water ball 100 is configured in a spherical shape. Understandably, in other embodiments, the toy water ball can also be shaped like an elliptical sphere or an irregular sphere, as long as it can carry water in the folded state. In this embodiment, the three petals 10 are of the same shape to facilitate mass production. In other embodiments, the three petals 10 can be different in size, as long as they can be arranged in a circle and fold up to form a sphere.

In this embodiment, each of the petals 10 is configured as an arc-shaped fan-like shell. Each of the petals 10 is integrally made of a soft material. In this way, people feel less pain when hit by the toy water ball, thus increasing the fun of entertainment. Specifically, each of the petals 10 is made of a light, thin, flexible and soft sheet such as a silicone sheet, and is somewhat elastic. In other embodiments, the first edge portion 11 and the second edge portion 12 of each of the petals 10 can be made of a different material separately and then integrally assembled together, for example, the first edge portion 11 and the second edge portion 12 are made of silicone, soft gel, the body/middle portion of the petal 10 is configured as a soft shell, and the three are connected to form an integral member by injection molding.

Figure 5:
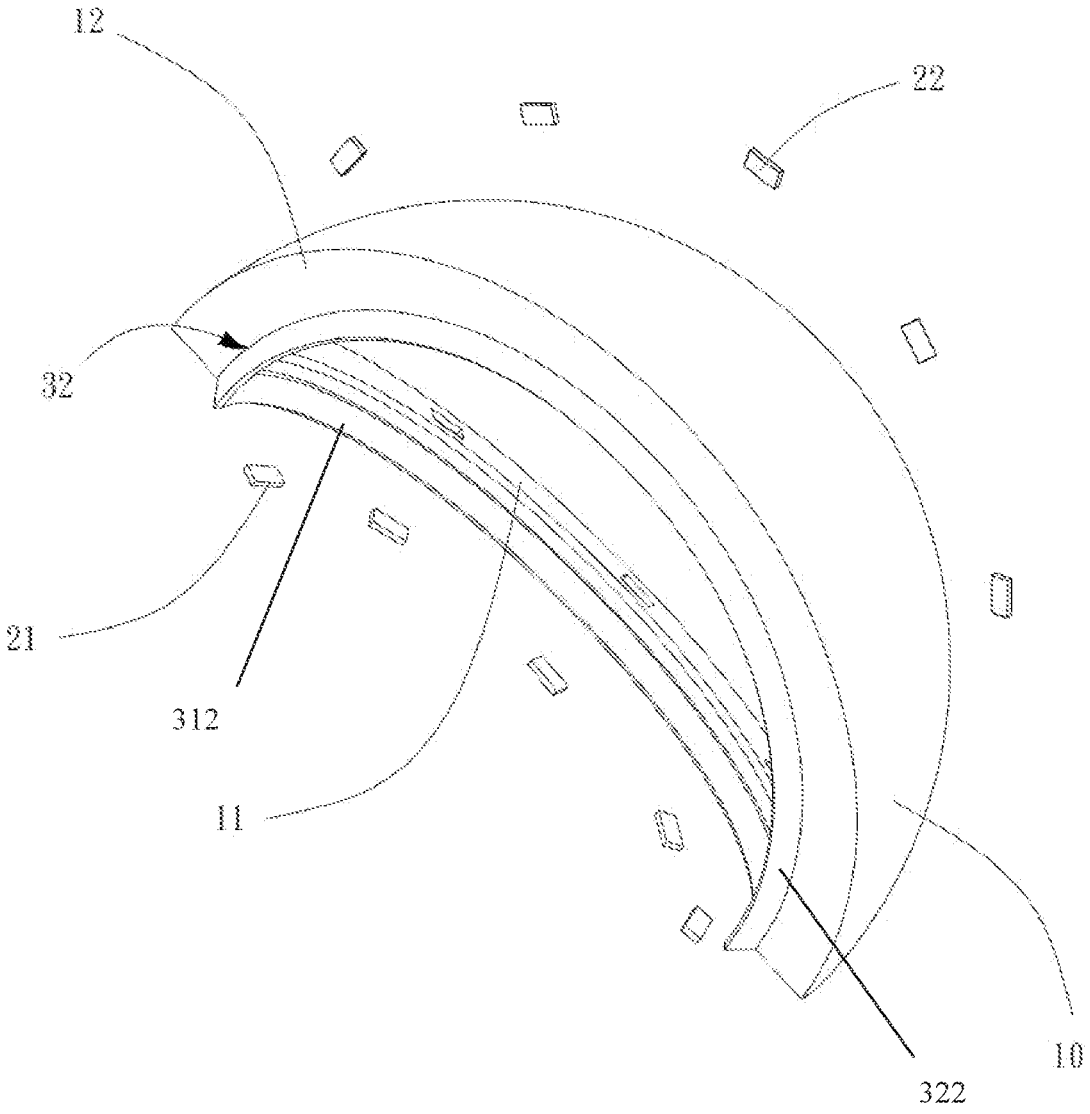
FIG. 5 is a perspective schematic view of one of the petals of the toy water ball of FIG. 2 tilted.
Figure 6:
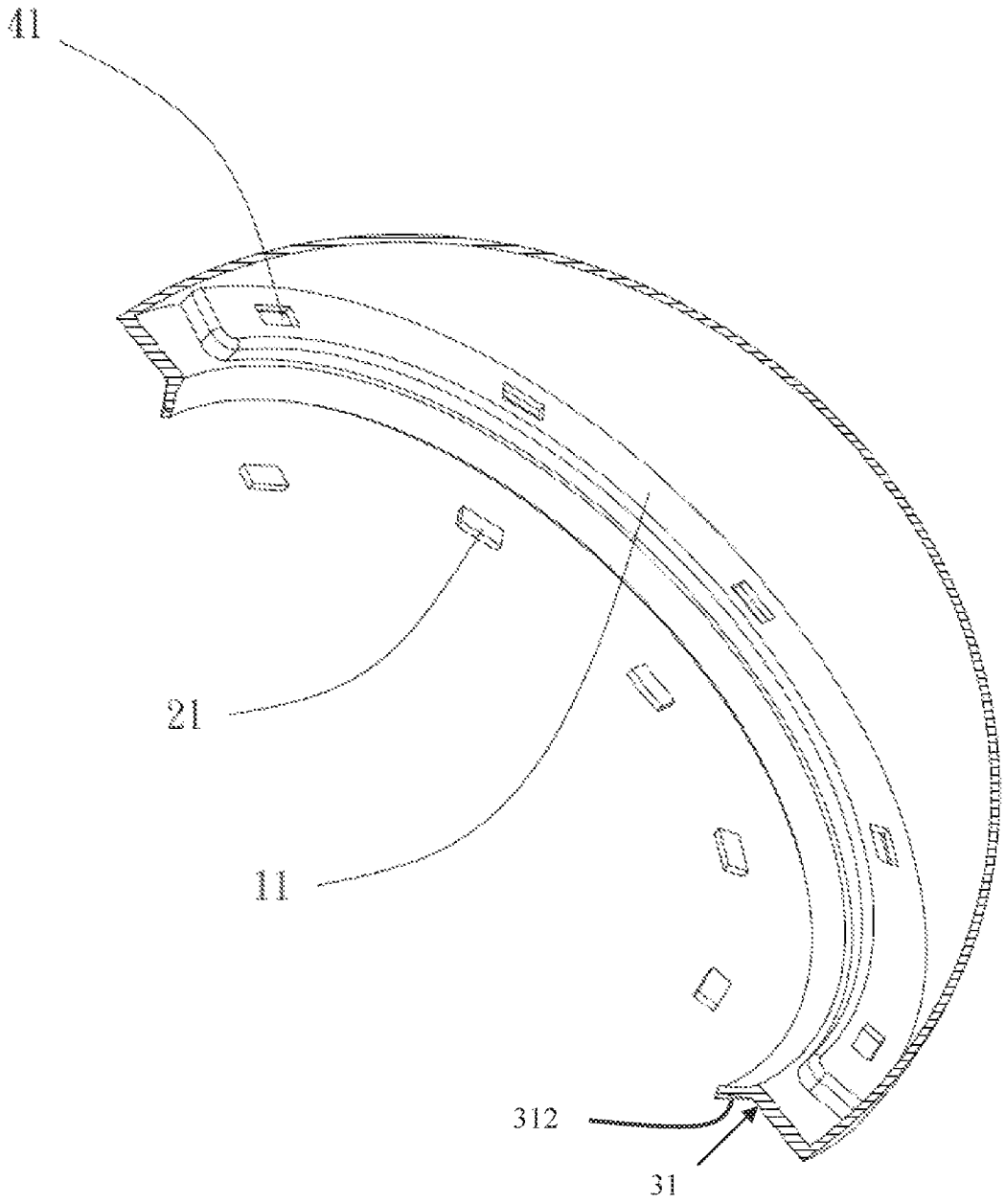
FIG. 6 is a perspective schematic view of a petal of FIG. 5 cut along the midline, in which first magnetic members and the petal are in an exploded state.

Referring to FIGS. 5 and 6, the first edge portion 11 and the second edge portion 12 of each of the petals 10 are located on opposite sides of the petal 10. In this embodiment, the first edge portion 10 of one of the petals 10 of the toy water ball 100 is provided with a plurality of first magnetic members 21, the second edge portion 12 of the petal 10 adjacent to the first edge portion 11 of the one of the petals 10 is provided with a plurality of second magnetic members 22, and the positions of the first magnetic members 21 of the one of the petals 10 are arranged in one-to-one correspondence with the positions of the second magnetic members 22 of the adjacent petal 10. Specifically, in this embodiment, the number of the first magnetic members 21 and the number of the second magnetic members 22 of each of the petals 10 are both five, and the positions of the first magnetic members 21 are arranged in one-to-one correspondence with the positions of the second magnetic members 22 so that the magnetic attraction force therebetween is maximized with a relatively light weight. Specifically, the first magnetic members 21 of the first edge portion 11 of the same petal 10 are spaced apart from each other, and the second magnetic members 22 of the second edge portion 12 of the same petal 10 are spaced apart from each other. In other embodiments, the number of the first magnetic members 21 or the second magnetic members 22 of the same petal 10 can be determined according to the size of the toy water ball 100 and the size of the first magnetic member 21 or the second magnetic member 22. The number of the first magnetic members 21 or the second magnetic members 22 can also be one. For example, one elongated first magnetic member and one elongated second magnetic member are applied for one petal. In a case where the plurality of first magnetic members 21 or the plurality of second magnetic members 22 are spaced apart, the weight of the toy water ball 100 associated with the first magnetic members 21 or the second magnetic members 22 can be reduced while a sufficient magnetic attraction force is ensured, and the lightness and entertainment interest of the toy water ball 100 can be improved.

In this embodiment, the first edge portion 11 of each of the petals 10 has a first fitting surface 31, and the first magnetic members 21 are mounted on an inner side of the first edge portion 11, the inner side facing away from the first fitting surface 31; the second edge portion 12 of each of the petals 10 has a second fitting surface 32, and the second magnetic members 22 are mounted on an inner side of the second edge portion 12, the inner side facing away from the second fitting surface 32.

The first fitting surface 31 and the second fitting surface 32 are both concavely arranged in a natural state and are prone to deformation when squeezed. When the first fitting surface 31 is fit on the corresponding second fitting surface 32 of the adjacent petal 10, under the action of magnetic attraction, the first fitting surface 31 and the second fitting surface 32 are deformed into a tight fit to form a sealed water-retaining layer to prevent the water loaded in the toy water ball 100 from leaking out in advance. Specifically, the first fitting surface 31 or the corresponding second fitting surface 32 of the adjacent petal 10 has an inclined surface leaning toward each other. Understandably, in other embodiments, the first fitting surface 31 or the second fitting surface 32 may be provided with a flat surface, as long as the sealed and water-retaining effect can be achieved when they are close to each other and fit together under the action of magnetic attraction.

Preferably, the first magnetic members 21 are arranged corresponding to a middle position of the first fitting surface 31, i.e., the midline between inner and outer edges of the first fitting surface 31. The inner edge of the first fitting surface 31 is close to the water-carrying cavity and the outer edge of the first fitting surface 31 is away from the water-carrying cavity. The second magnetic members 22 are arranged corresponding to a middle position of the second fitting surface 31. Specifically, the first magnetic members 21 are mounted and fixed inside the first edge portion 11 to avoid affecting the waterproof effect of the first fitting surface 31; similarly, the second magnetic members 22 are mounted and fixed inside the second edge portion 12 to avoid affecting the waterproof effect of the second fitting surface 32.

In this embodiment, an inner side of the first edge portion 11 of each of the petals 10 is provided with a first groove 41, and the first magnetic members 11 [sic] are fixed in the first groove 41. The first magnetic members 21 are fixed on the first edge portion 11 by binding/adhering/bonding. An inner side of the second edge portion 12 of each of the petals 10 is provided with a second groove (not shown), and the second magnetic members 22 are fixed in the first grooves [sic]. The second magnetic members 22 are fixed on the second edge portion 12 by binding/adhering/bonding. Understandably, in other embodiments, the first magnetic members 21 may also be fixed on the first edge portion 11 by means of snap connection, integral molding, or the like; the second magnetic members 22 may also be fixed on the second edge portion 12 by means of snap connection, integral molding, or the like.

In this embodiment, the first magnetic members 21 and the second magnetic members 22 are both magnets, and both shaped like rectangular blocks. The first magnetic members 21 of the first edge portion 11 and the second magnetic members 22 of the adjacent second edge portion 12 are opposite in polarity to achieve the effect of attracting each other when approaching. In other embodiments, the first magnetic members 21 are magnets and the second magnetic members 22 are iron blocks, or the first magnetic members 21 are iron blocks and the second magnetic members 22 are magnets, which can also achieve a mutual magnetic attraction effect.

Figure 7:
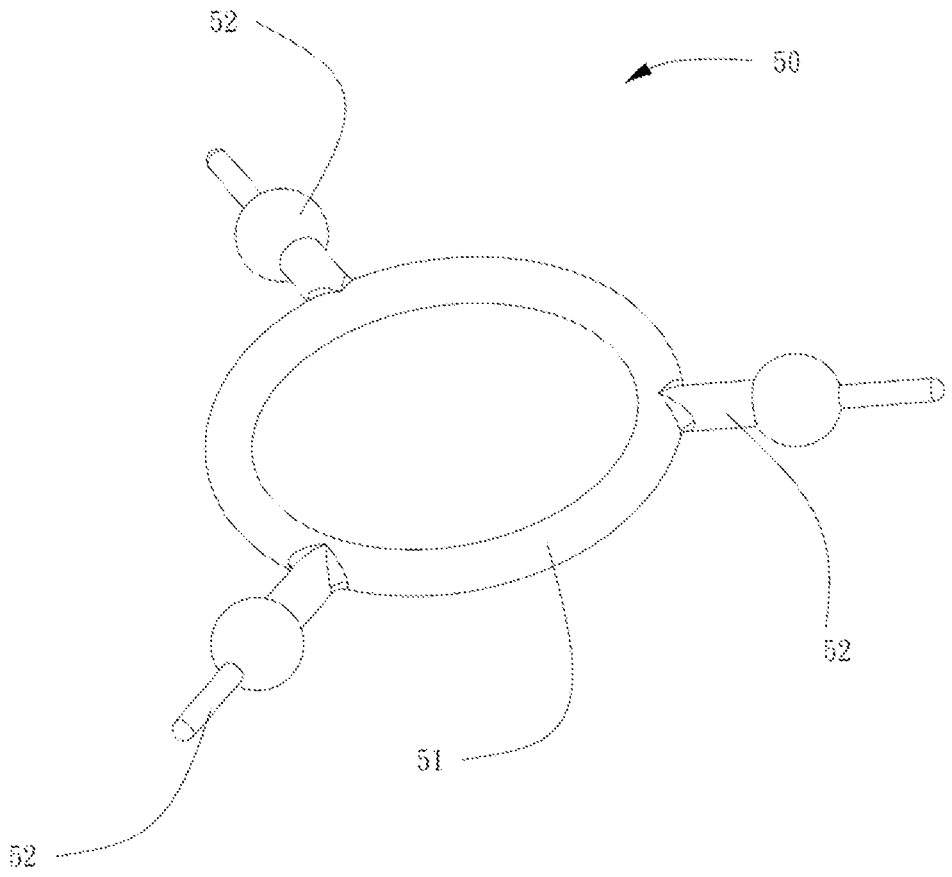
FIG. 7 is a perspective schematic view of a connecting member of the toy water ball of FIG. 1.

Referring also to FIG. 7, the toy water ball 100 further includes a connecting member 50 that connects each of the petals 10 respectively. The connecting member 50 includes an elastic connecting ring 51 and connecting ends 52 respectively connecting the connecting ring 51 to each of the petals 10. The connecting end 52 is connected to the same end of each of the petals 10. After each of the petals 10 is connected by the connecting member 50, when the toy water ball 100 is thrown out and hits a person or falls on the ground and splits open, each of the petals 10 can be well connected, and there is no need to pick the petals up one by one. Understandably, in some embodiments, the connecting ring 51 can be configured as a common inelastic rope. In addition, in embodiments where few petals 10 are provided, the connecting member 50 can be omitted. For example, in the case of three petals 10 in this embodiment or in the case of two petals 10 in other embodiments, without the connecting member 50, the toy water ball still can be used normally.

In use of the toy water ball 100, a player can hold or grip the toy water ball 100 and put it directly into a water source, for example, in water in a bucket, river, or sea, and then squeeze the toy water ball 100 hard to deform the petals 10 to a certain extent, so that a gap is formed between two adjacent petals 10 to allow water inflow. After water flows into the toy water ball 100, the player unlooses the toy water ball 100, the first edge portion 11 and the second edge portion 12 of the adjacent petals 10 come into a tight fit by virtue of the magnetic attraction between the first magnetic members 21 and the second magnetic members 22, thus achieving the sealed waterproof effect. When the toy water ball 100 fully filled with water is thrown out and hits a person or an object, the adjacent petals 10 are forced to depart from each other, the toy water ball 100 splits open, and the water in the toy water ball 100 splashes out to achieve the game effect.

Compared with an existing water balloon, the toy water ball of the invention is provided with the first magnetic members and the second magnetic members, so that the toy water ball can be folded or opened repeatedly and thus can be reused; therefore, the water ball is environmentally friendly and clean. In addition, the toy water ball can be filled with water in a common water source without a specific pressure, so it can be used in many occasions, and has strong applicability.

Figure 8:
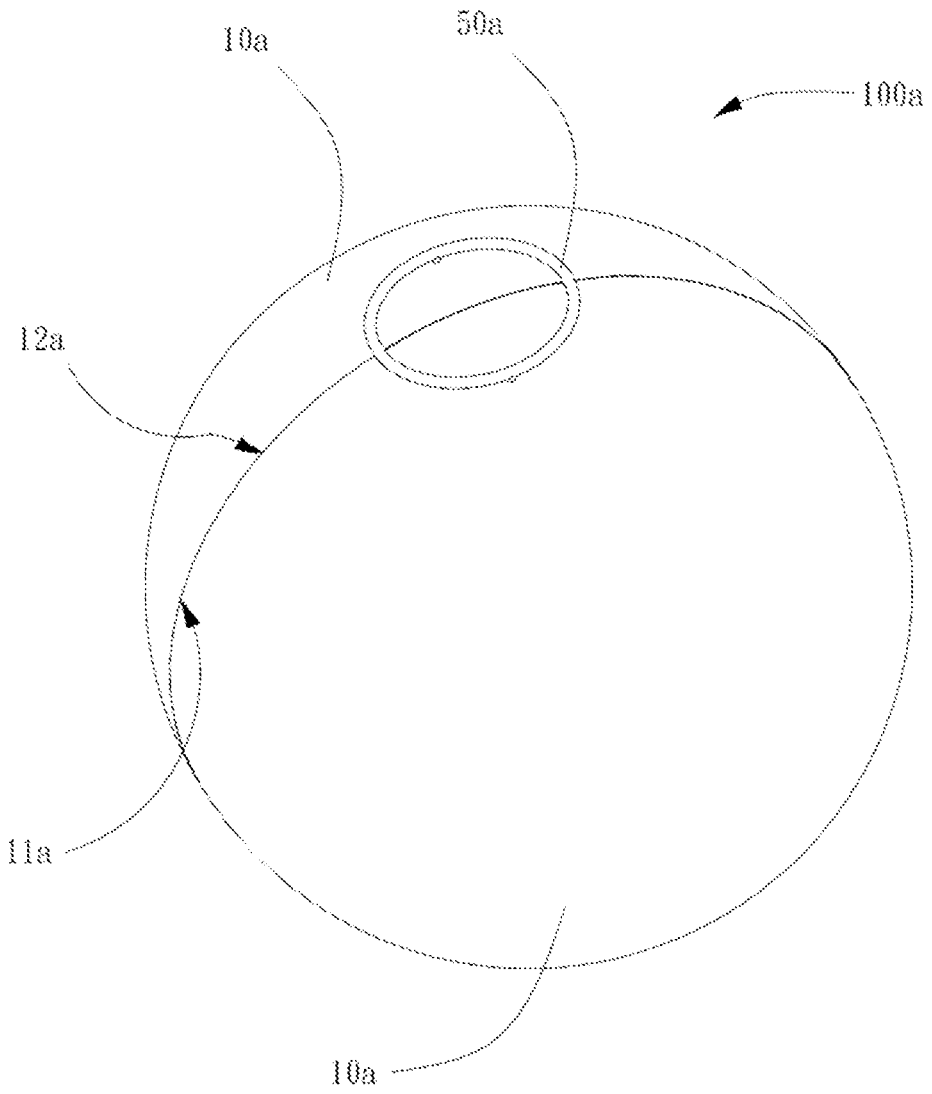
FIG. 8 is a perspective schematic view of a toy water ball according to a second embodiment.

Referring to FIG. 8, a toy water ball 100*a* according to a second embodiment of the invention is illustrated. The toy water ball 100*a* includes a plurality of petals 10*a*, and each of the petals 10*a* has a first edge portion 11*a* and a second edge portion 12*a*; each of the first edge portions 11*a* is provided with first magnetic members (not shown), and each of the second edge portions 12*a* is provided with second magnetic members (not shown). The toy water ball 100*a* of the second embodiment is similar to the toy water ball 100 of the first embodiment except that the number of the petals 10*a* in the toy water ball 100*a* of the second embodiment is two, and each of the petals 10*a* is configured as a hemispherical shell. The toy water ball 100*a* further includes a connecting member 50*a* respectively connected to each of the petals 10*a*.

Figure 9:
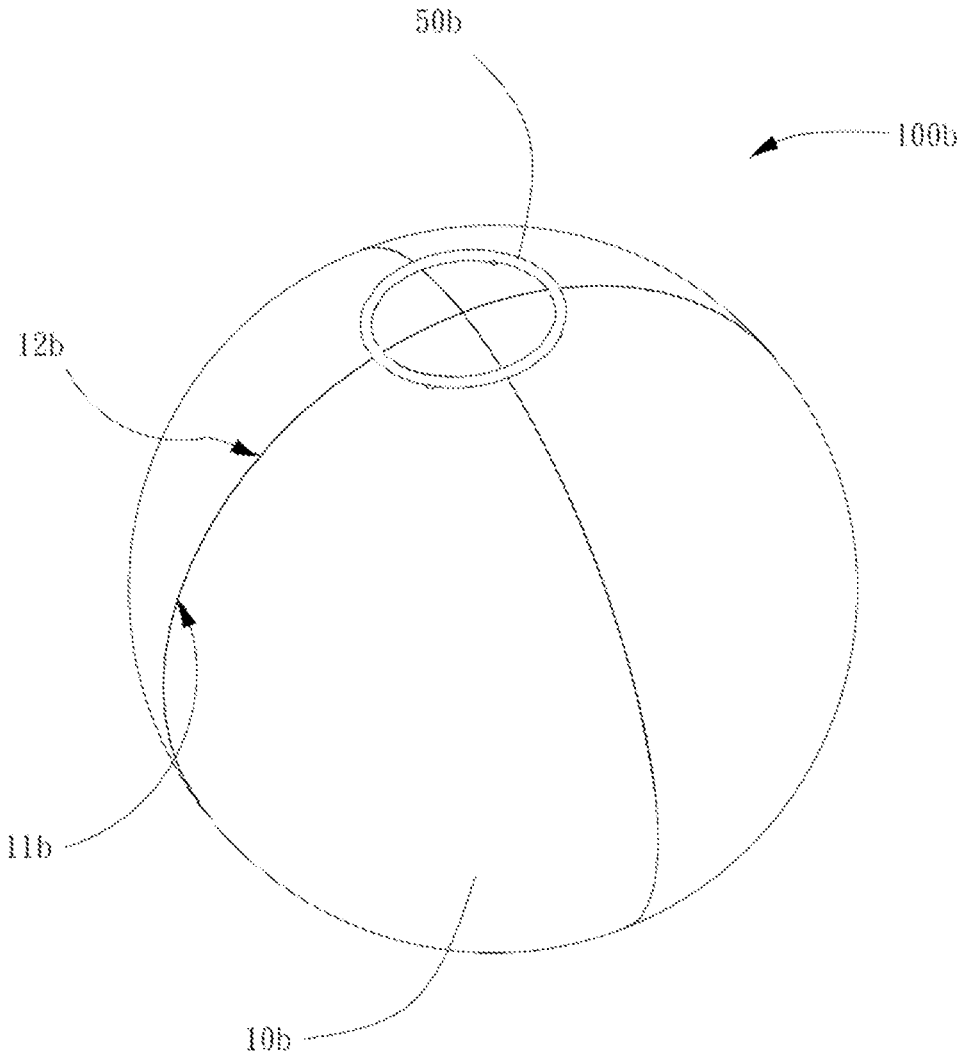
FIG. 9 is a perspective schematic view of a toy water ball according to a third embodiment.

Referring to FIG. 9, a toy water ball 100*b* according to a third embodiment of the invention is illustrated. The toy water ball 100*b* includes a plurality of petals 10*b*, and each of the petals 10*b* has a first edge portion 11*b* and a second edge portion 12*b*; each of the first edge portions 11*b* is provided with first magnetic members (not shown), and each of the second edge portions 12*b* is provided with second magnetic members (not shown). The toy water ball 100*b* of the third embodiment is similar to the toy water ball 100 of the first embodiment except that the toy water ball 100*b* of the third embodiment has four petals 10*b*, and each of the petals 10*b* is configured as a one-fourth-sphere shell. The toy water ball 100*b* further includes a connecting member 50*b* respectively connected to the petals 10*b*.

Figure 10:
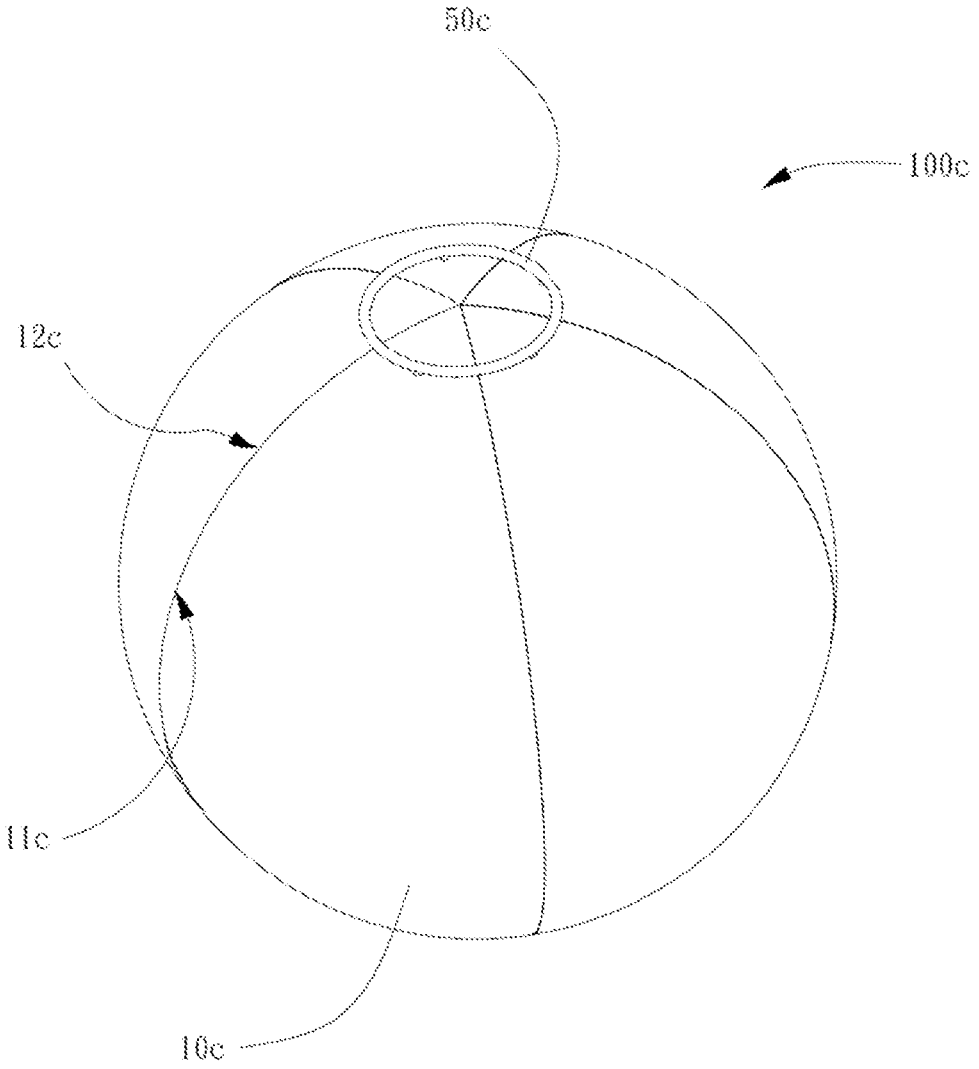
FIG. 10 is a perspective schematic view of a toy water ball according to a fourth embodiment.

Referring to FIG. 10, illustrated is a toy water ball 100*c* according to a fourth embodiment of the invention. The toy water ball 100*c* includes a plurality of petals 10*c*, and each of the petals 10*c* has a first edge portion 11*c* and a second edge portion 12*c*; each of the first edge portions 11*c* is provided with first magnetic members (not shown), and each of the second edge portions 12*c* is provided with second magnetic members (not shown). The toy water ball 100*c* of the fourth embodiment is similar to the toy water ball 100 of the first embodiment except that the toy water ball 100*c* of the fourth embodiment has five petals 10*c*, and each of the petals 10*c* is configured as a one-fifth-sphere shell. The toy water ball 100*c* further includes a connecting member 50*c* respectively connected to the petals 10*c*.

Figure 11:
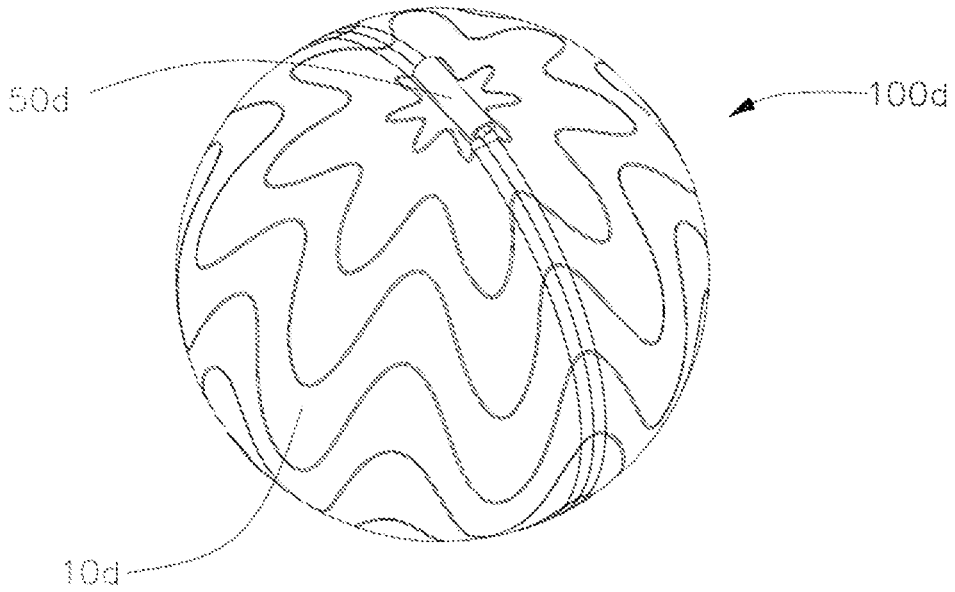
FIG. 11 is a perspective schematic view of a toy water ball according to a fifth embodiment.
Figure 12:
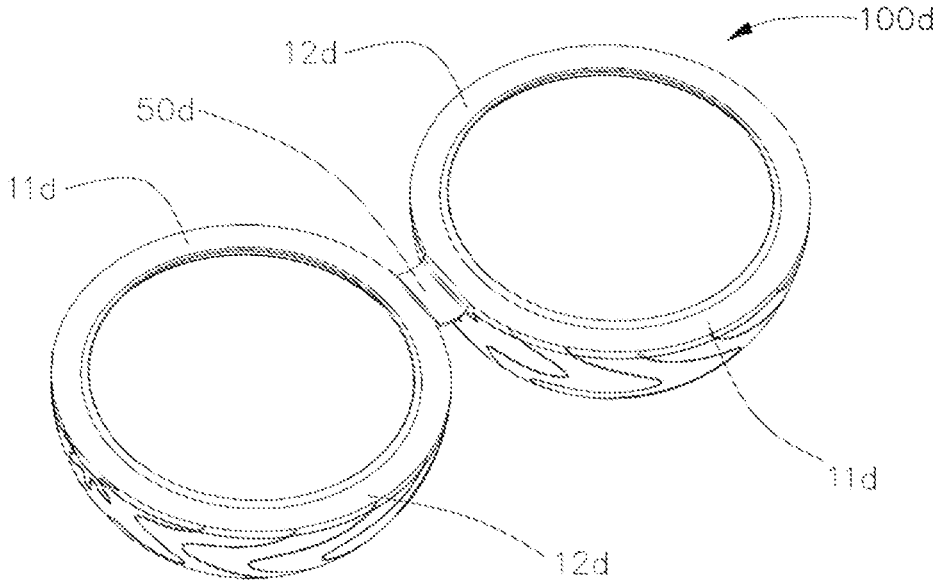
FIG. 12 is a perspective schematic view of the toy water ball of FIG. 11 in an opened state.
Figure 13:
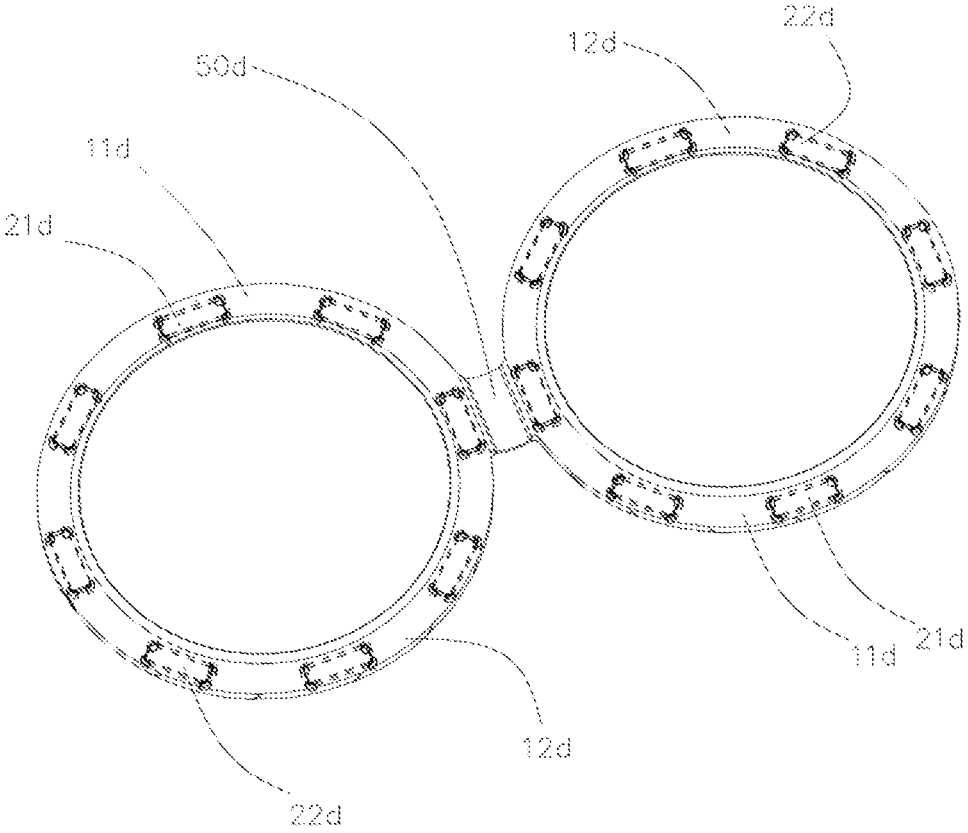
FIG. 13 shows a connecting member of the toy water ball of FIG. 12 and a first edge portion and a second edge portion of each of the petals.

Referring to FIGS. 11 to 13, illustrated is a toy water ball 100*d* according to a fifth embodiment of the invention. The toy water ball 100*d* includes a plurality of petals 10*d*, and each petal 10*d* has a first edge portion 11*d* and a second edge portion 12*d*; each first edge portion 11*d* is provided with first magnetic members (as shown in FIG. 13), and each second edge portion 12*d* is provided with second magnetic members (shown in FIG. 13). The toy water ball 100*d* of the fifth embodiment is similar to the toy water ball 100*a* of the second embodiment except that the toy water ball 100*d* of the fifth embodiment further includes a connecting member 50*d* respectively connected to the petals 10*d* and the connecting member 50*d* is configured as a sheet. In this embodiment, the connecting member 50*d* is integrally formed with the first edge portion 11*d* and the second edge portion 12*d* of each petal 10*d*, and then is connected to a main body of each petal 10*d*. In this embodiment, an outer surface of each petal 10*d* is provided with a wave-like pattern.

Figure 14:
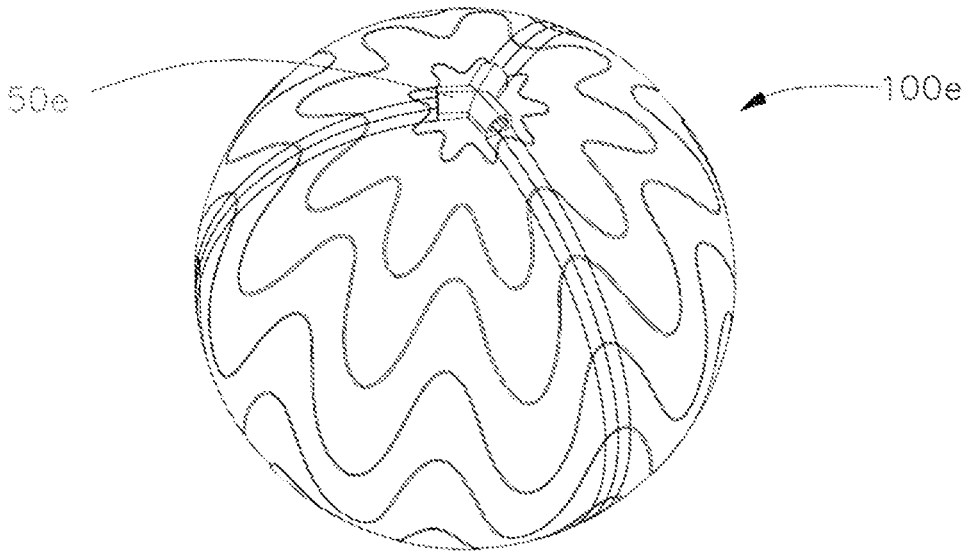
FIG. 14 is a perspective schematic view of a toy water ball according to a sixth embodiment.
Figure 15:
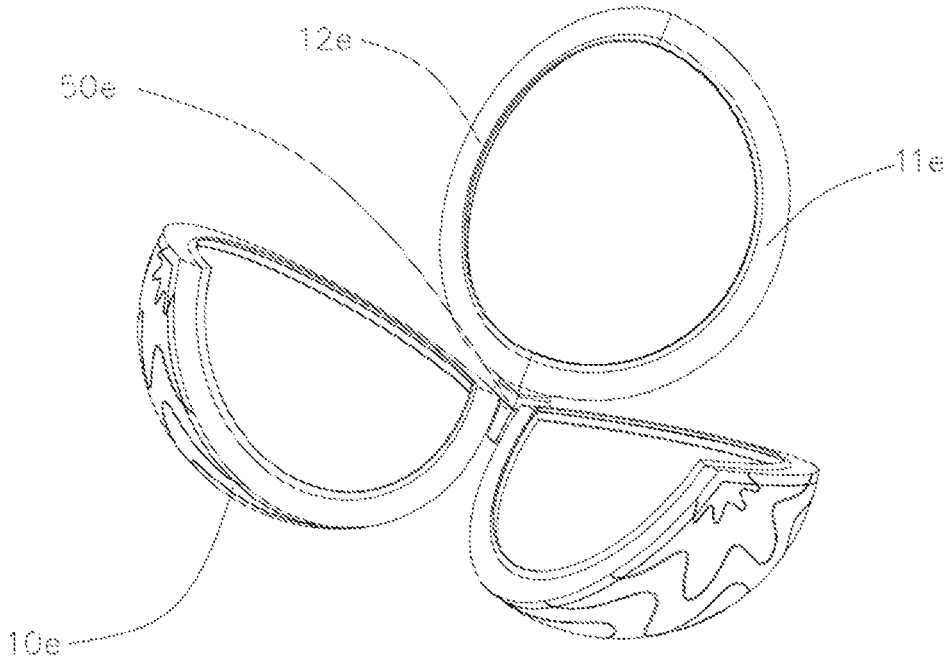
FIG. 15 is a perspective schematic view of the toy water ball of FIG. 14 in an opened state.

Referring to FIGS. 14 and 15, illustrated is a toy water ball 100*e* according to a sixth embodiment of the invention. The toy water ball 100*e* includes a plurality of petals 10*e*, and each petal 10*e* has a first edge portion 11*e* and a second edge portion 12*e*; each first edge portion 11*e* is provided with first magnetic members (not shown), and each second edge portion 12*e* is provided with second magnetic members (not shown). The toy water ball 100*e* of the sixth embodiment is similar to the toy water ball 100 of the first embodiment except that the toy water ball 100*e* of the sixth embodiment further includes a connecting member 50*e* respectively connected to the petals 10*e* and the connecting member 50*e* is configured as a sheet. In this embodiment, the connecting member 50*e* is integrally formed with the first edge portion 11*e* and the second edge portion 12*e* of each petal 10*e*, and then is connected to the main body of each petal 10*e*. In this embodiment, an outer surface of each petal 10*e* is provided with a wave-like pattern.

Understandably, the toy water ball of the invention is not limited to being filled with water, and the toy water ball of the invention can be used to be filled with other liquids suitable for people's entertainment, such as beer, milk or other liquids harmless to the human body or drinkable.

The above-described embodiments only show several implementations of the invention, which are more specific and detailed, but not to be construed as limiting the patent scope of the invention. It should be noted that those of ordinary skill in the art may further make variations and improvements without departing from the conception of the invention, and these all fall within the protection scope of the invention. Therefore, the patent protection scope of the invention should be subject to the appended claims.

What is claimed is:

1. A toy water ball, comprising:

a first petal comprising an elastic silicone material, the first petal further comprising a silicone sheet configured as a first hemispherical shell, a first edge portion comprising a first fitting surface, and a first magnetic member mounted and fixed inside the first edge portion away from the first fitting surface; and a second petal comprising an elastic silicone material, the second petal further comprising a silicone sheet configured as a second hemispherical shell, a second edge portion comprising a second fitting surface, and a second magnetic member mounted and fixed inside the second edge portion away from the second fitting surface, wherein the toy water ball is movable between a closed state and an open state, wherein the first magnetic member and the second magnetic member are configured to generate a magnetic attraction force when the toy water ball is in the closed state, the first petal and the second petal forming a closed water-carrying cavity when the toy water ball is in the closed state, wherein the magnetic attraction force is sufficient to cause the first edge portion and the second edge portion to contact each other, wherein the toy water ball is configured such that when placed into water while in the open state and moved to the closed state while still in the water, the first petal and the second petal form the closed water-carrying cavity by way of the magnetic attraction force, the closed water-carrying cavity having at least a portion of the water stored therein, and wherein the toy water ball is configured such that when removed from the water in the closed state and is thrown and hits an object, the first petal and the second petal separate and turn the toy water ball to the open state thereby causing the water stored in the closed water-carrying cavity to be released.

2. The toy water ball of claim 1 further comprising a connecting member that connects the first petal to the second petal.

3. The toy water ball of claim 2 wherein the connecting member is configured as a sheet.

4. The toy water ball of claim 2 wherein the connecting member is integrally formed with the first edge portion and the second edge portion.

5. The toy water ball of claim 2 wherein the closed state comprises a folded state.

6. The toy water ball of claim 5 wherein the open state comprises an unfolded state.

7. The toy water ball of claim 6 wherein the connecting member connects the first petal and the second petal when the toy water ball is in the unfolded state.

8. The toy water ball of claim 1 wherein the first fitting surface of the first petal and the second fitting surface of the second petal are deformed to form a sealed water-retaining layer under action of the magnetic attraction force.

9. The toy water ball of claim 8 wherein the first fitting surface and the second fitting surface are deformed into a tight fit.

10. The toy water ball of claim 1 wherein the first hemispherical shell of the first petal is integrally formed with the first edge portion.

11. The toy water ball of claim 1 wherein the first magnetic member is shaped a rectangular block and the second magnetic member is shaped a rectangular block.

12. The toy water ball of claim 1 wherein the first magnetic member is fixed in the first edge portion by integrally molding the first magnetic member in the first edge portion.

13. The toy water ball of claim 12 wherein the second magnetic member is fixed in the second edge portion by integrally molding the second magnetic member in the second edge portion.

14. The toy water ball of claim 1 wherein the first fitting surface comprises a slope and the second fitting surface comprises a slope; and wherein the slope of the first fitting surface and the slope of the second fitting surface are tilted to each other.

15. The toy water ball of claim 1, wherein when the toy water ball is compressed to split, the first petal is forced to depart from the second petal.

16. A toy water ball, comprising:

a first petal comprising an elastic silicone material, the first petal further comprising a silicone sheet configured as a first hemispherical shell, a first edge portion comprising a first fitting surface, and at least five first magnetic members mounted and fixed inside the first edge portion away from the first fitting surface; and a second petal comprising an elastic silicone material, the second petal further comprising a silicone sheet configured as a second hemispherical shell, a second edge portion comprising a second fitting surface, and at least five second magnetic members mounted and fixed inside the second edge portion away from the second fitting surface, wherein the toy water ball is movable between a closed state and an open state, wherein the first magnetic members and the second magnetic members are configured to generate a magnetic attraction force when the toy water ball is in the closed state, the first petal and the second petal forming a closed water-carrying cavity when the toy water ball is in the closed state, wherein positions of the first magnetic members are arranged in one-to-one correspondence with positions of the second magnetic members, wherein the magnetic attraction force is sufficient to cause the first edge portion and the second edge portion to contact each other, wherein the toy water ball is configured such that when placed into water while in the open state and moved to the closed state while still in the water, the first petal and the second petal form the closed water-carrying cavity by way of the magnetic attraction force, the closed water-carrying cavity having at least a portion of the water stored therein, and wherein the toy water ball is configured such that when removed from the water in the closed state and is thrown and hits an object, the first petal and the second petal separate and turn the toy water ball to the open state thereby causing the water stored in the closed water-carrying cavity to be released.

17. The toy water ball of claim 16, wherein the toy water ball is configured such that when thrown during use and hits the object, the silicone sheet is compressed and the first petal and the second petal separate and turn the toy water ball to the open state.

* * * * *